US007263812B2

(12) United States Patent
von Triel et al.

(10) Patent No.: US 7,263,812 B2
(45) Date of Patent: Sep. 4, 2007

(54) BEVERAGE BOTTLING PLANT FOR FILLING BOTTLES WITH A LIQUID BEVERAGE MATERIAL HAVING A MACHINE AND METHOD FOR WRAPPING FILLED BOTTLES

(75) Inventors: Manfred von Triel, Xanten (DE); Tuchwat Schagidow, Geldern (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 11/175,002

(22) Filed: Jul. 5, 2005

(65) Prior Publication Data

US 2006/0026926 A1 Feb. 9, 2006

(30) Foreign Application Priority Data

Jul. 6, 2004 (DE) ..... 10 2004 032 528

(51) Int. Cl.
*B65B 17/00* (2006.01)
*B65H 19/18* (2006.01)
*B65B 3/00* (2006.01)

(52) U.S. Cl. ..... 53/167; 242/555; 156/159; 156/504

(58) Field of Classification Search ..... 156/157, 156/159, 502, 504; 53/167; 242/554.2, 242/555, 556
See application file for complete search history.

(56) References Cited

U.S. PATENT DOCUMENTS 2,010,908 A 8/1935 Wood
3,705,069 A * 12/1972 Elrod ..... 156/502
4,067,760 A * 1/1978 Nelson ..... 156/157
5,252,170 A * 10/1993 Schaupp ..... 156/504
5,284,197 A * 2/1994 Cederholm et al. ..... 156/157
5,863,381 A * 1/1999 Magota et al. ..... 156/159
5,935,361 A * 8/1999 Takahashi et al. ..... 156/159
6,096,150 A * 8/2000 Ohno ..... 156/157
6,500,288 B2 * 12/2002 Hara et al. ..... 156/159
6,814,827 B2 * 11/2004 Futase ..... 156/157
6,923,880 B2 * 8/2005 Keene et al. ..... 156/159
2003/0042351 A1 3/2003 Robitaille
2003/0141020 A1 * 7/2003 Hoffmann et al. ..... 156/502
2004/0112527 A1 * 6/2004 Keene et al. ..... 156/502
2004/0140044 A1 * 7/2004 Rassi et al. ..... 156/157

FOREIGN PATENT DOCUMENTS

DE 3816775 A1 12/1988
EP 0780331 A2 6/1997
WO WO89/03450 A 4/1989

OTHER PUBLICATIONS

European Patent Office Search Report EP1614646A3 and English translation thereof.

* cited by examiner

*Primary Examiner*—Louis Huynh
(74) *Attorney, Agent, or Firm*—Nils H. Ljungman & Associates

(57) ABSTRACT

A beverage bottling plant for filling bottles with a liquid beverage material having a machine and method for wrapping filled bottles, wherein one roll of wrapping material is replaced with a new roll of wrapping material quickly and accurately to minimize disruptions or interruptions in the bottle wrapping process.

20 Claims, 10 Drawing Sheets

BEVERAGE BOTTLING PLANT FOR FILLING BOTTLES WITH A LIQUID BEVERAGE MATERIAL HAVING A MACHINE AND METHOD FOR WRAPPING FILLED BOTTLES

BACKGROUND

1. Technical Field

The present application relates to a beverage bottling plant for filling bottles with a liquid beverage material having a machine for wrapping filled bottles.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

On packaging machines, the packaging or flat material (e.g. packaging film) to be used is drawn off rolls and fed to the process sequence. When a roll that has just been in use is about to come to an end, the conventional practice to return the packaging machine to operation as quickly as possible is to keep at least one replacement or connecting roll in the supply unit, the flat material of which is then connected during a brief machine shutdown by means of a leader or connecting area to the flat material on the roll that was in use before the roll change, and specifically by connecting this connecting area with the flat material of the roll that was previously in use, and then by cutting through the flat material on this roll. Then the packaging machine can be restarted, whereby the flat material is then drawn off the connecting roll.

To achieve a secure connection and a smooth transition when changing a roll of printed packaging or flat material so that, among other things, the register and the distances between the printed images etc. on the packaging material can be kept constant even in the connecting area, in addition to a correct and accurately positioned stopping of the movement of the packing material of the roll that is in use, it is also necessary for the connecting area of the packaging material of the connecting roll to be accurately positioned in the connecting station where the connection is to be made. In the prior art, that means that after the insertion of a connecting roll into the supply unit, the connecting roll and its connecting area by which it is to be connected must be correctly oriented in the connecting station, which is a complicated process that takes a lot of time, especially on packaging machines that are still running and in particular given the very limited accessibility of the respective connecting station in systems of the prior art.

OBJECT OR OBJECTS

The object is to describe a method with which the roll change can be performed quickly and easily, and with particular regard to the accurate positioning of the connecting area of the connecting roll. The present application teaches a method as disclosed herein below. A supply unit for the performance of this method is also described hereinbelow.

SUMMARY

The present application teaches the accurate positioning of the connecting area of the connecting roll wherein, in a workplace outside the supply area, a holding and positioning element is fastened to this connecting area so that it is correctly oriented to guarantee a smooth and accurate connection. When the connecting roll is inserted into the supply unit, this holding and positioning element is inserted into a receptacle of the connecting station so that then the connecting area of the connecting roll is automatically correctly positioned for the transitional connection. All the actions required to achieve this object are performed in a workplace that is located outside the supply unit and that offers unrestricted access.

It is also possible in particular to prepare the new connecting roll that is to be inserted into the supply unit with the holding and positioning element after the respective roll change and after the removal of the empty roll while the machine is still running and before the roll change, so that the roll change can be performed extremely quickly.

The method taught by the present application also makes possible a computer-controlled roll change.

In one preferred embodiment, the connection necessary for the connecting of the two rolls is performed by welding, and thereby preferably by a welding cutting operation.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described in the dependent claims. The present application is explained in greater detail below with reference to one exemplary embodiment that is illustrated in the accompanying figures, in which:

DESCRIPTION OF EMBODIMENT OR EMBODIMENTS

Figure 1:
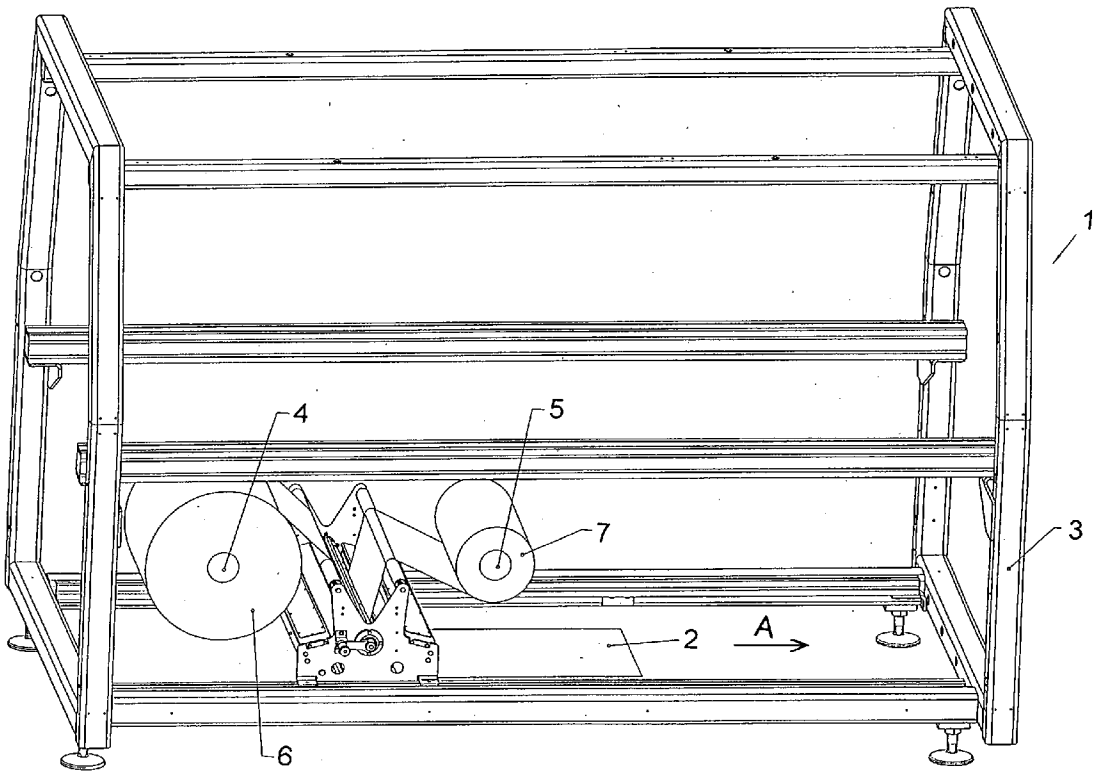
FIG. 1 is a simplified side view of a film feeding station or a supply unit for the feed of a packaging film to a packaging machine.
Figure 1A:
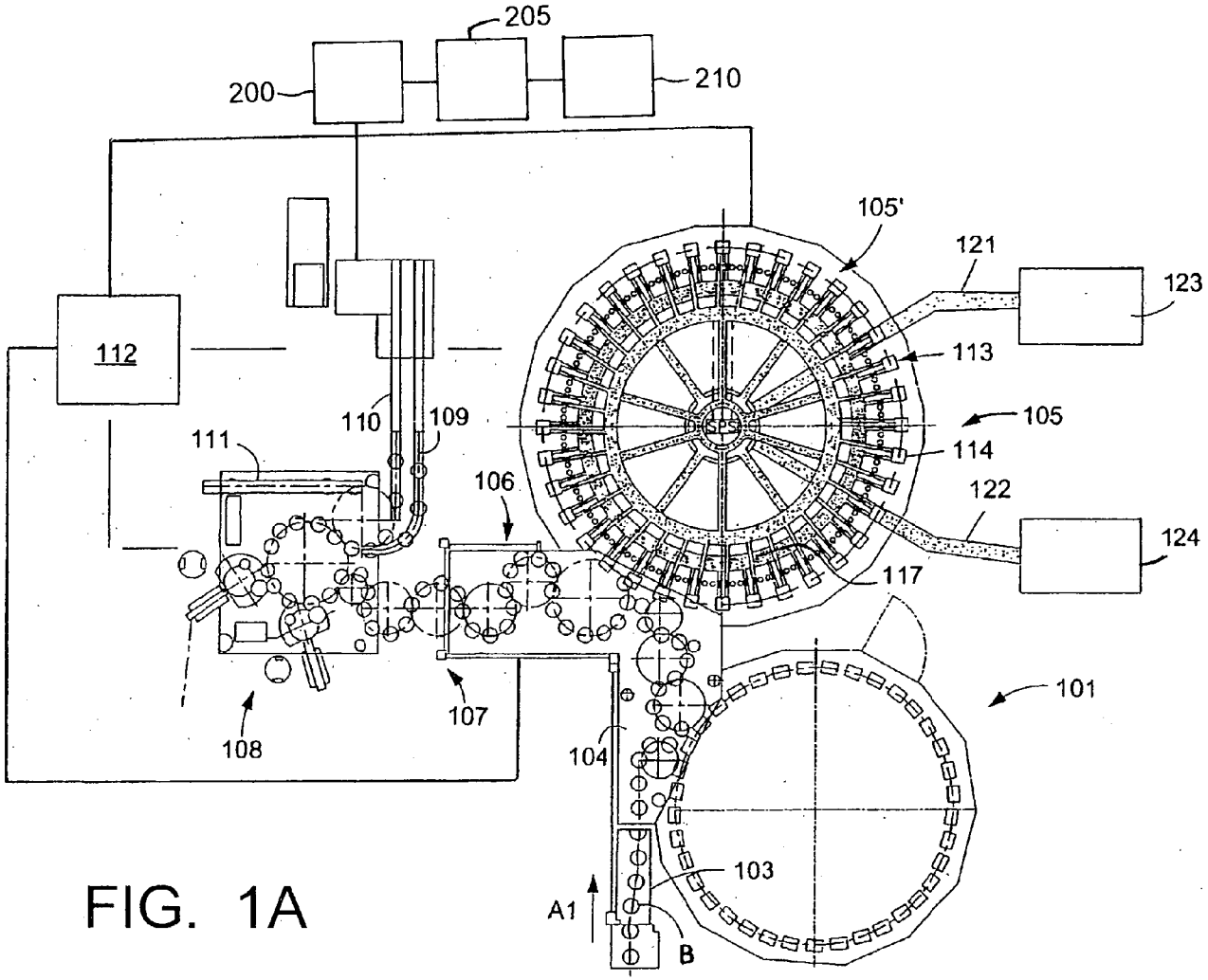
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

FIG. 1A further shows a packaging machine 200, a bottle shrink wrapping machine 205, and a shrink wrapping tunnel 210, each of which are indicated in FIG. 1A by boxes after the labeling station 108.

Figure 1B:
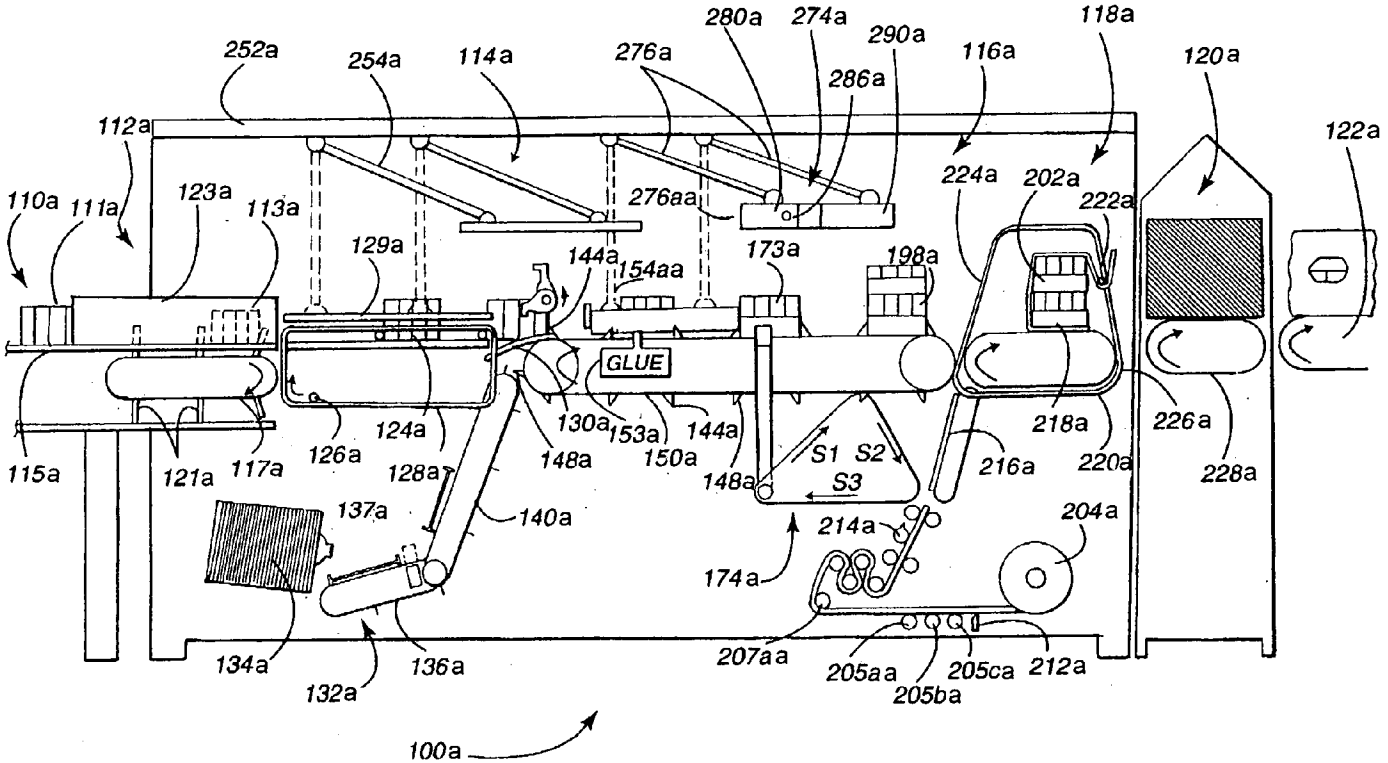
FIG. 1B PRIOR ART
FIG. 1B is prior art, showing a schematic representation side view of a packing-shrink wrapping apparatus set up for use in single lane mode of operation.
Figure 1C:
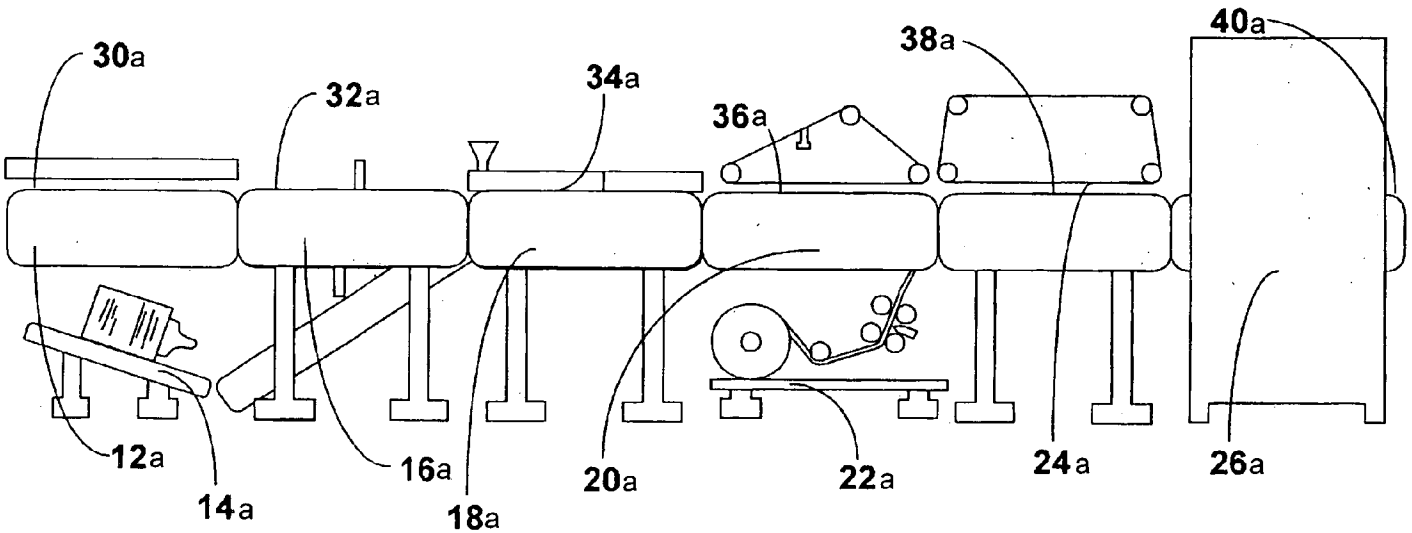
FIG. 1C PRIOR ART
FIG. 1C is prior art, showing a schematic representation of the operation of the film wrapping section of a packing-shrink wrapping apparatus.
Figure 2:
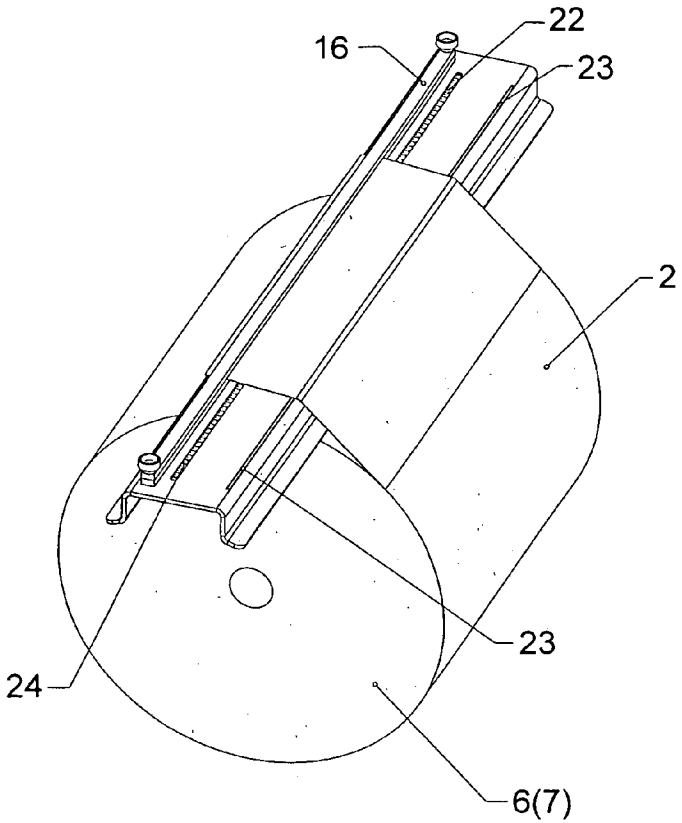
FIG. 2 is a simplified view in perspective of a film roll together with a holding and positioning element that is realized in the form of a pinch rail or clamp rail and a gauge formed by a guide ruler for the fastening of the pinch rail in the correct position to the beginning of the film on the film roll.

FIGS. 1B and 1C show possible embodiments of a wrapping machine for shrink wrapping bottles, components of which may possibly be utilized or adapted for use in at least one possible embodiment of the present application. FIG. 1B is prior art, showing a schematic representation side view of a packing-shrink wrapping apparatus set up for use in single lane mode of operation. FIG. 1B is taken from U.S. Pat. No. 5,765,336, entitled "Single and dual lane traypacker and shrinkwrapper," issued to Neagle, et al. on Jun. 16, 1998, where FIG. 1B was previously numbered FIG. 3. A detailed description of FIG. 1B, which was formerly FIG. 3, can be found in U.S. Pat. No. 5,765,336 in columns 4-9. FIG. 1C is also prior art, showing a schematic representation of the operation of the film wrapping section of a packing-shrink wrapping apparatus. FIG. 1C is taken from U.S. Pat. No. 6,484,475, entitled "Modular packaging machine," issued to Neagle, et al. on Nov. 26, 2002, where FIG. 1C was previously FIG. 11. A detailed description of FIG. 1C, which was previously FIG. 11, can be found in U.S. Pat. No. 6,484,475 in columns 7-11. Please note that all reference numerals in FIGS. 1B and 1C have an "a" added to the end of each reference numeral in order to distinguish the prior art in FIGS. 1B and 1C from the present application.

Figure 3:
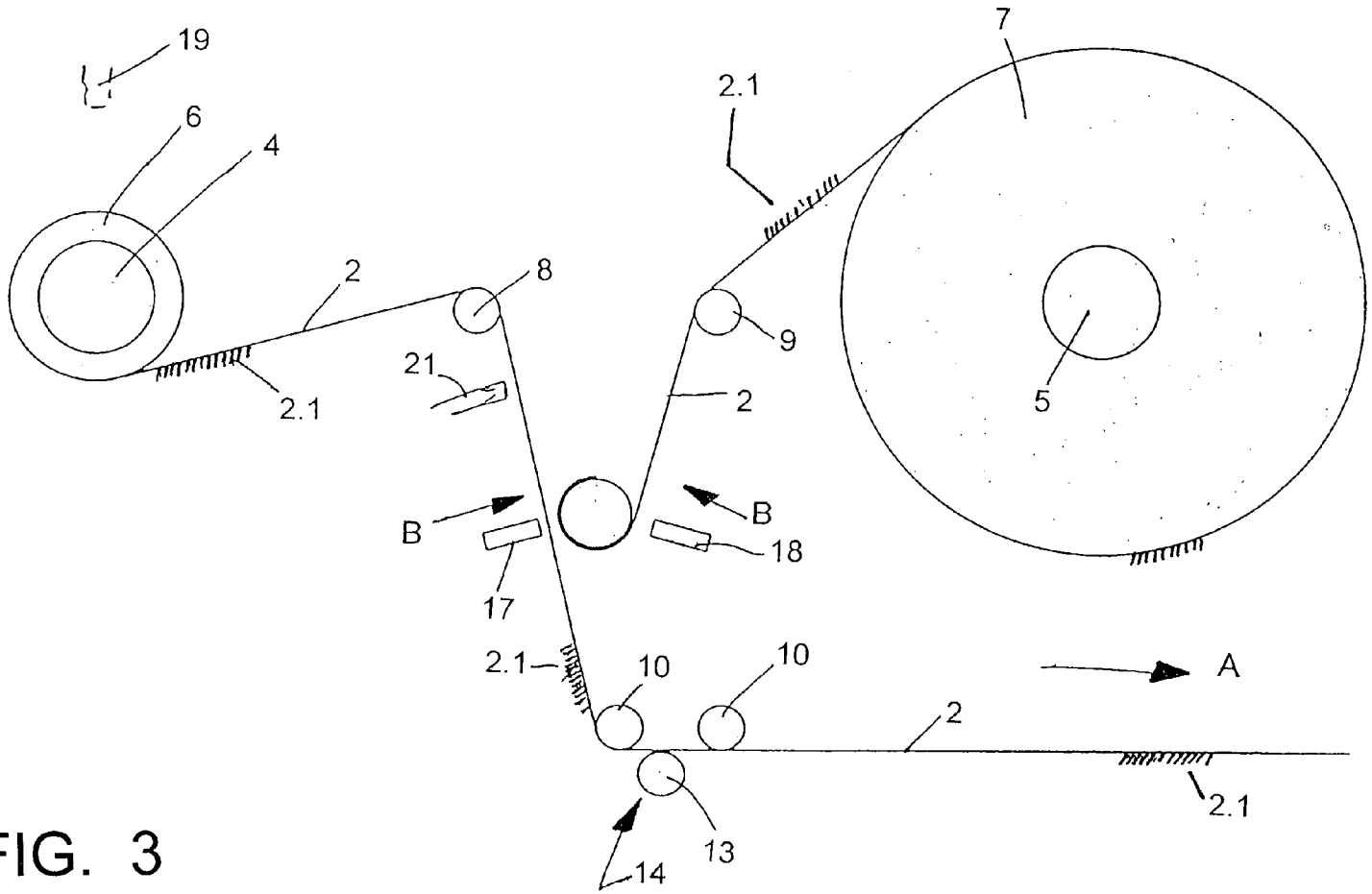
FIGS. 3 and 4 are schematic views of the essential elements of a film welding station of the supply unit illustrated in FIG. 1, respectively during the roll change and during the connection of the film on a new film roll to the film on a film roll that was previously used in the machine.
Figure 4:
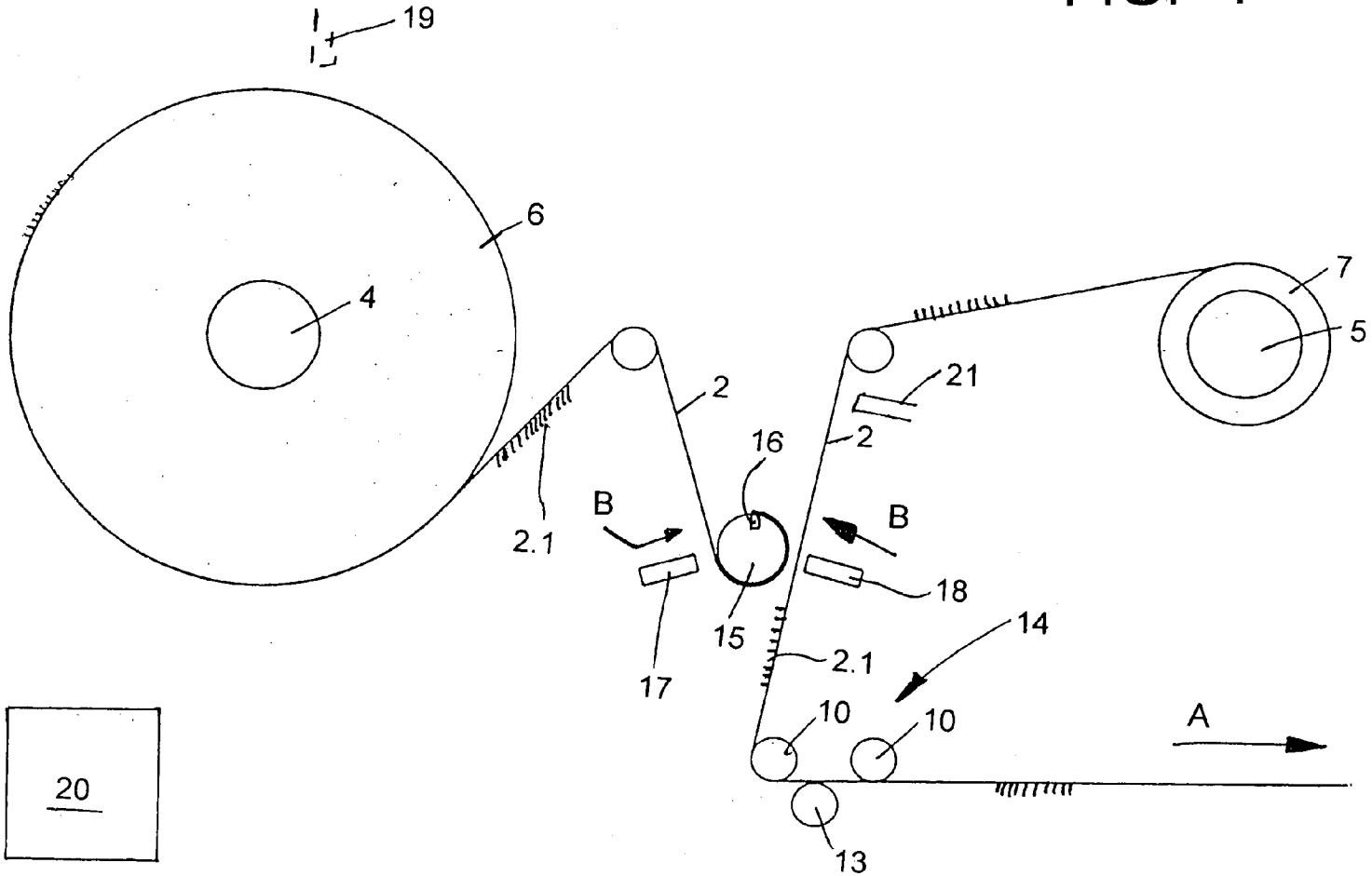

The supply unit, which is designated 1 in general, is used to feed a weldable plastic or packaging film 2 to a packaging machine (not shown). For this purpose, the supply unit 1 has, in a machine frame 3, two parallel mandrels 4 and 5 that are oriented with their axis in the horizontal direction, each of which is used to hold a film roll 6 or 7 respectively, one roll of which is always the roll that is being used on the running packaging machine, from which the strip-shaped film 2 is pulled off in the direction indicated by the arrow A and is fed to the packaging machine, while the other replacement or connecting roll is the roll that is kept ready for a roll change. FIGS. 3 and 4 each show one status of the supply unit 1 immediately prior to a roll change—again the two mandrels 4 and 5 which are parallel to each other with their axes and perpendicular to the plane of the drawing in FIGS. 3 and 4, the film rolls 6 and 7 provided on said mandrels and additional deflector and guide rollers 8-10 for the film 2 that are oriented with their axes parallel to one another and parallel to the mandrels 4 and 5. These deflector and guide rollers 8-10 are each mounted on both ends so that they can rotate in a frame 11 of a film connecting or welding station 12 that is also mounted in the machine frame 3.

The deflector roller 8 is thereby associated with the mandrel 4 and the deflector roller 9 is associated with the mandrel 5. The two bottom deflector rollers 10 in FIGS. 3 and 4, together with an additional roller 13 that can be moved radially with respect to its axis into the space between the axes 10, form a device 14 that achieves the most constant mechanical film tension possible, and in particular also prevents sudden changes in the film tension and any sudden shocks to the film during a roll change.

An additional component of the welding station 12 is a receptacle 15 that is rotationally mounted on both ends in the frame 11 for the holding and positioning element, which is also called the pinch rail or clamp rail 16 below, which can be fastened in the correct position and with its longitudinal dimension parallel to the axis of rotation of the receptacle 15. In the illustrated exemplary embodiment, the receptacle 15 is a shaft or roller to which the pinch rail 16 can be suitably fastened, for example by insertion into a groove that forms the mounting. For the manual rotation of the receptacle 15 around its axis, a notch lever 15.1 that is freely accessible is provided, with which the receptacle 15 can be blocked in position by locking even after a 360° rotational movement. In the locked position of the receptacle 15, the mounting provided on this receptacle for the pinch rail 16 is located on the upper peripheral area of the receptacle 15.

Other components of the welding station 12 include two heated welding rails 17 and 18 which lie with their longitudinal dimension parallel to the axis of rotation of the receptacle 15 and are offset around this axis of rotation by an angle of slightly less than 180°. With the pinch rail 16, which is positioned correctly and immovably on the receptacle 15, for example by index pins that are engaged in positioning openings of the receptacle 15, the connecting area of the film of the connecting roll that is ready for the roll change can be connected in the correct orientation, and namely so that when the roll is changed, the film on the new film roll will be connected to the film on the old film roll so that the register, printed images etc. on the film match and are in the correct relative positions.

FIG. 3 shows the status of the supply unit 1 shortly before the very end of the film roll 6 that is in use has been reached, whereby the film 2 is fed over the deflector rollers 8 and the device 14 formed by the rolls 10 and 13 which keep the film tension of the packaging machine constant as indicated by Arrow A. The beginning of the film 2 on the film roll 7 that is ready for the roll change and is guided over the deflector rollers is connected with the pinch rail 16 that is fastened to the receptacle 15 and is looped around the periphery of the receptacle so that the beginning of this film lies in the vicinity of the welding rail 17 next to the film 2 that has been taken off the film roll 6, and the film 2 is stretched by the pinch rail 16 in the direction of movement indicated by the arrow A.

The film roll 6 that is in use is constantly monitored by means of a sensor that is schematically designated 19 in FIG. 3. When the sensor 19, which works together with a control computer 20 of the packaging machine, detects the approach of the end of the film roll 6, the roll change is initiated by the control computer 20. For this purpose, first the packaging machine is stopped and the removal of the film 2 from the film roll 6 is slowed down. By means of an additional sensor 21 that scans the film 2 or markings or printed marks 2.1 on the film, the decelerated removal of the film 2 is then stopped when the film 2 is positioned in the welding position formed by the welding rail 17 so that the result is a smooth, strong connection, with the proper register of printed patterns, to the film roll 7 that is ready to be connected (connecting roll). Then, still controlled by the control computer 20, the welding rail 17 is moved out of the idle position into the welding position, whereby by means of a cutting welding process, the film 2 on the film roll 7 is connected with the film strip that leads to the packaging machine and simultaneously the connection produced by the welding process is separated from the remaining film on film roll 6 and from the film that remains on the pinch rail 16.

To achieve a correct and particularly strong film weld seam, a braking device, for example an inflatable or pneumatic brake, is activated for the performance of the welding process, by means of which the permanent tension that is exerted on the film is reduced or even eliminated, at least in the vicinity of the film weld seam to be created.

After the completion of the welding cutting operation, the packaging machine is restarted by the control computer 20, whereby the film 2 is then pulled off the film roll 7. The film roll 6 is manually removed from the supply unit, as well as the pinch rail 16. To prepare for the next roll change when the film on roll 7 has been used up, a new film roll 6 that is already provided with the pinch rail is placed on the mandrel 4, the pinch rail 16 is inserted into the receptacle 15 and this roll is manually rotated by 360° around its axis, so that the receptacle 15 is once again looped around by the beginning of the film that is connected with the pinch rail 16. FIG. 4 shows the status of the system immediately before the film on roll 7 comes to an end.

The accurate positioning of the pinch rail 16 takes place outside the packaging machine and the supply unit 1 in a workplace where the work can be done easily and comfortably, and which offers full and unrestricted access to, among other things, the respective rolls 6 and 7. This workplace includes, among other things, a gauge in the form of a guide ruler 22 on which the respective pinch rail 16 can be accurately positioned, and specifically, for example, once again using index pins that are engaged in positioning openings. By means of markings 23 and 24 that are provided on the guide ruler 22 and by markings, e.g. printed marks 2.1 on the film 2, it is then possible to position the pinch rail 16 on the film 2 in a manner that guarantees the connection or welding with the proper matching of registers.

The pinch rail 16 is inserted into the receptacle, as described above, with the receptacle 15 in the locked position, in which position the pinch rail mounting of the receptacle 15 is on the upper side of said receptacle. In the illustration selected for FIG. 3, after the fastening of the pinch rail 15, the receptacle is rotated clockwise by means of the notch lever 15.1 to prepare the film roll 7 for use as the connecting roll, so that the receptacle 15 with its peripheral area which is next to the film 2 that is in use is moved in the direction opposite to the transport or pull-off direction B of the film. The rotation of the receptacle 15 is ended after 360° by locking the notch lever 15.1, so that the pinch rail 16 is once again in the upper area, i.e. in the position in which said rail was inserted into the receptacle 15, and the partial length that is looped around the receptacle 15 and connected to the pinch rail 16 is in an overlapping connection with the film. For the preparation of the film roll 6 as the connecting roll, the receptacle 15 is rotated counterclockwise with the pinch rail 16. As a result of this configuration, it is possible to make the overlapping connection of the films 2 and the separation of the film 2 that was previously being used from the roll 6 or 7 respectively, and to separate the connected film 2 from the pinch rail 16 in a single step by a welding cutting operation.

Figure 3A:
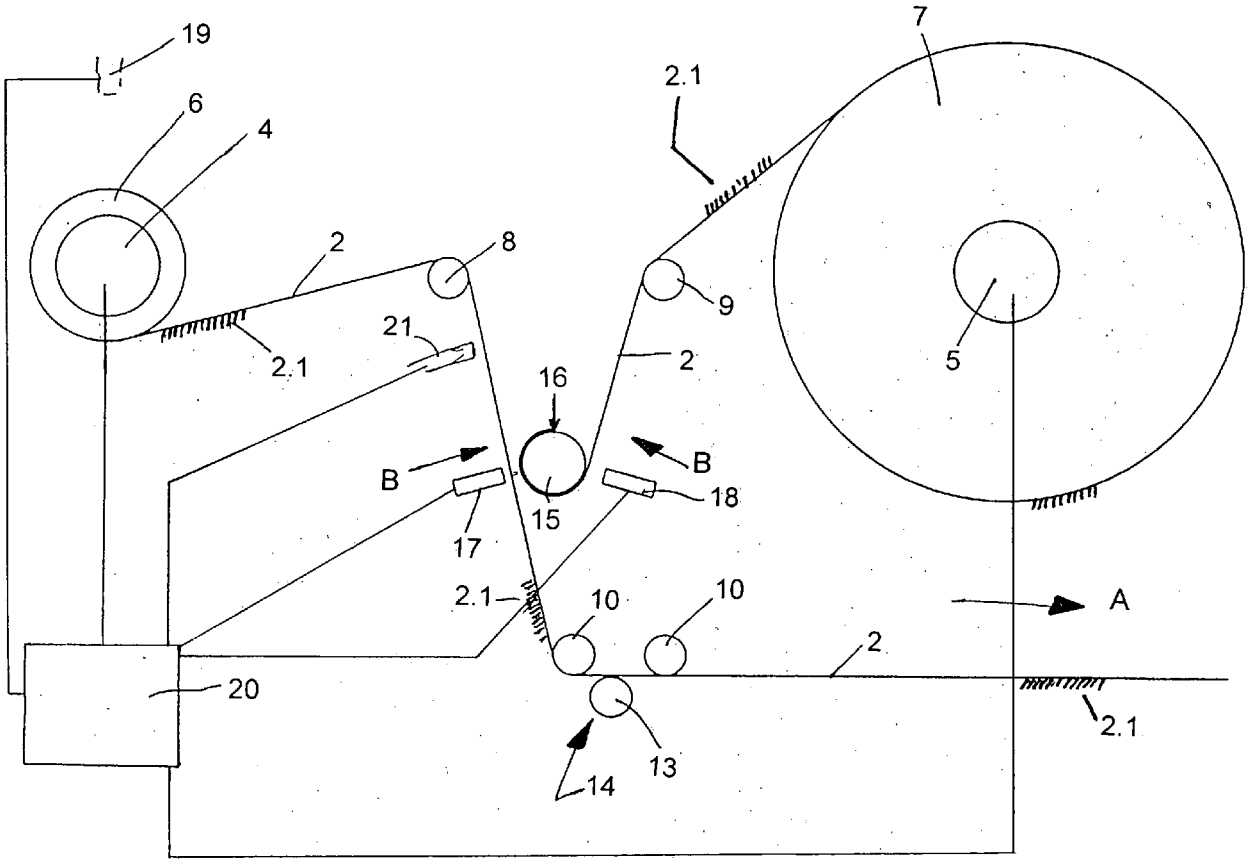
FIG. 3A is similar to FIG. 3, and shows further details according to one possible embodiment.
Figure 4A:
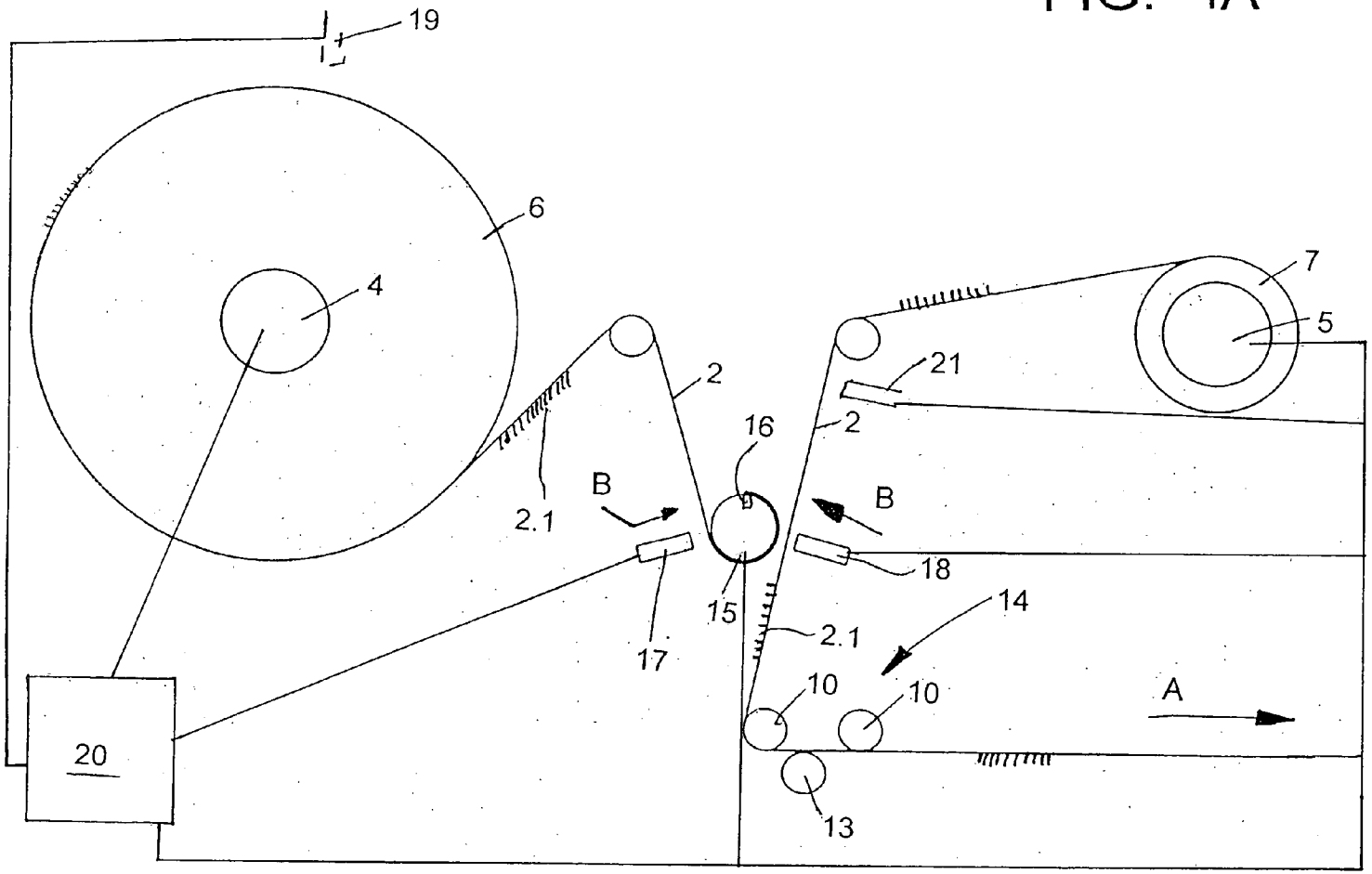
FIG. 4A is similar to FIG. 3A, and shows further details according to one possible embodiment.

FIG. 3A is similar to FIG. 3, and shows further details according to one possible embodiment. According to FIG. 3A, the control computer 20 has an operable connection to the sensors 19 and 21 so that the sensors 19 and 21 can send signals to the control computer 20 when necessary, as described herein above. The control computer 20 is further configured to send signals to the welding rails 17 and 18, the mandrels 4 and 5, the rotating receptacle 15, and the actuator elements 25 for the welding rails 17 and 18. FIG. 4A is similar to FIG. 3A, and shows the above operable connections to the control computer 20 for the opposite side of the packaging station.

Figure 5:
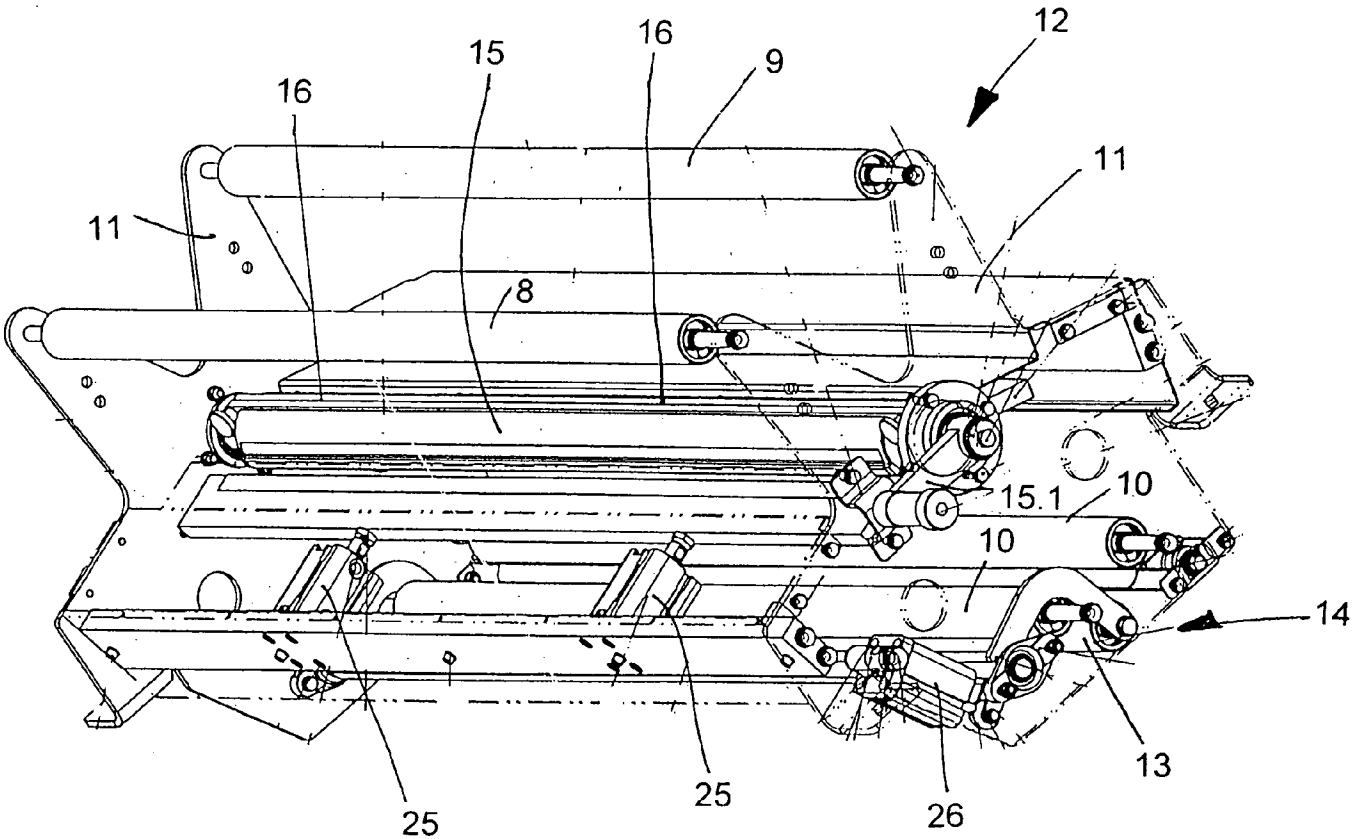
FIG. 5 is an individual view in perspective of the connection or welding station of the supply unit illustrated in FIG. 1.

FIG. 5 shows in detail the individual elements of the welding or connecting station 12 described above. This figure also shows the actuator elements 25 for the welding rails 17 and 18. In the illustrated exemplary embodiment, these actuator elements are pneumatic cylinders that are controlled by the control computer 20 by means of control valves (not shown).

FIG. 5 also shows an actuator element 26 which can also be a pneumatic actuator element, for example, and by which, inside the equalizing station 14, the radial feed motion of the roller 13 is controlled to achieve the most constant possible movement of the film strip.

This measure is necessary, among other things, to prevent the jerking of the film when the welding process has ended and the machine starts up again.

To apply the proper tension to control the play/overhang of the film, the roller 13 pivots into the path of the film after the welding process has been completed, stretches the film and thus also applies a tension to the film overhang. Then the braking device used to reduce the tension applied to on the film is released and the machine is restarted. When, after a brief time, the machine has reached normal operating speed once again, the equalizing 14 is once again pivoted out of the film path.

The present application was described above on the basis of one exemplary embodiment. It goes without saying that numerous variations and modifications are possible without thereby going beyond the teaching of the present application. For example, it is also possible to provide additional braking and clamping means on the welding station 12 to ensure that the films are not under any unwanted tension during the welding process.

The present application relates to a method for the performance of a roll change on a supply unit that is used to feed a strip-format flat material to a packaging machine or similar processing machine from a roll that forms a supply of flat material, the connecting area of the connecting roll that is ready for the roll change is fastened to a holding and positioning element which for its part is held in a defined position in a receptacle of a connecting station.

One feature or aspect of an embodiment is believed at the time of the filing of this patent application to possibly reside broadly in a method for performing a roll change on a supply unit that feeds a strip-shaped flat material to a packaging machine or similar processing machine from rolls that form a supply of flat material, whereby for the roll change, in which in a connecting station, the flat material of the roll that is in use is connected with a leading or connecting area of a previously prepared connecting roll, this connecting area is accurately positioned in the connecting station to achieve a connection with matching registers, and after the connection has been made the flat material is separated from the roll that was in use up to the time of the roll change, characterized by the fact that for the correct positioning of the connecting area of the flat material of the connecting roll, a holding and positioning element is fastened in the desired position and orientation in a workplace outside the supply unit, and that before the role change, the connecting area of the connecting roll is positioned with the holding and positioning element in the receptacle provided on the connecting station.

Another feature or aspect of an embodiment is believed at the time of the filing of this patent application to possibly reside broadly in a method for performing a roll change on a supply unit, characterized by the fact that the holding and positioning element is a pinch rail.

Yet another feature or aspect of an embodiment is believed at the time of the filing of this patent application to possibly reside broadly in a method for performing a roll change on a supply unit, characterized by the fact that the holding and positioning element is fastened to the connecting area in the correct position using a gauge that is located in or on the holding and positioning element in a specified position and orientation, and using markings on this gauge and/or on the flat material.

Still another feature or aspect of an embodiment is believed at the time of the filing of this patent application to possibly reside broadly in a method for performing a roll change on a supply unit, characterized by the fact that the connection of the flat material on the roll that is in use with the connecting area of the flat material on the connecting roll is realized in an overlapping manner, and namely so that the overlapping connection forms a lapped connection on one side of the strip of the flat material.

A further feature or aspect of an embodiment is believed at the time of the filing of this patent application to possibly reside broadly in a method for performing a roll change on a supply unit, characterized by the fact that after the insertion of the holding and positioning element, the receptacle on the connecting station is rotated around an axis that lies parallel to the plane of the flat material on the roll that is in use as it moves past the receptacle and perpendicular to the direction of movement of said flat material, for example over an angular range of 360°, so that the connecting area overlaps the flat material on the roll that was in use before the roll change, and extends, starting at this overlap, from the holding and positioning element in the direction of movement (A) of the flat material that is in use.

Another feature or aspect of an embodiment is believed at the time of the filing of this patent application to possibly reside broadly in a method for performing a roll change on a supply unit, characterized by the fact that during the roll change and before the connection of the connecting area of the connecting roll, the movement of the flat material in use is stopped in a controlled manner, so that taking into consideration the correct positioning of the holding and positioning element in the receptacle, the flat material of the connecting roll can be connected to the flat material in use with accurate register matching.

Yet another feature or aspect of an embodiment is believed at the time of the filing of this patent application to possibly reside broadly in a method for performing a roll change on a supply unit, characterized by the fact that the movement of the flat material that is in use is stopped in a controlled manner for the roll change by means of markings, e.g. printed marks that are provided on the flat material.

Still another feature or aspect of an embodiment is believed at the time of the filing of this patent application to possibly reside broadly in a method for performing a roll change on a supply unit, characterized by the fact that the fastening of the holding and positioning element in the correct position in the separate workplace is done taking into consideration markings on the flat material, for example taking printed marks into consideration.

A further feature or aspect of an embodiment is believed at the time of the filing of this patent application to possibly reside broadly in a method for performing a roll change on a supply unit, characterized by the fact that the flat material is a weldable film, and that the connection during the roll change is effected by welding, preferably by a welding cutting operation.

Another feature or aspect of an embodiment is believed at the time of the filing of this patent application to possibly reside broadly in a method for performing a roll change on a supply unit, characterized by the fact that after the connection or during the connection, the flat material is separated from the holding and positioning element.

Yet another feature or aspect of an embodiment is believed at the time of the filing of this patent application to possibly reside broadly in a method for performing a roll change on a supply unit, characterized by the fact that the roll change, i.e. the controlled stopping of the flat material that was in use before the roll change, the connection and separation of the flat material from the roll that was in use before the roll change and from the holding and positioning element and the subsequent additional removal of the flat material from the connecting roll are controlled by a computer.

Still another feature or aspect of an embodiment is believed at the time of the filing of this patent application to possibly reside broadly in a method for performing a roll change on a supply unit, characterized by the fact that the roll change is initiated by at least one sensor that monitors the strip of the flat material in use or the roll that is in use.

A further feature or aspect of an embodiment is believed at the time of the filing of this patent application to possibly reside broadly in a supply unit to feed a strip-format flat material to a packaging machine or similar processing machine, with at least two roll receptacles, each of which holds a supply of flat material in the form of a roll, from at least one roll of which, namely the role that is in use, the flat material is pulled off during the operation of the packaging machine or similar processing machine, and at least one additional roll forms a connecting roll that is ready for the roll change, with a connecting station through which the flat material of the roll that is in use is transported, and on which, in a connecting position, a connecting area of the flat material of the connecting roll is located and positioned correctly for a connection so that the registers are matched correctly, characterized by the fact that at the connecting position, a receptacle is provided in which a holding and positioning element that is fastened to the connection area of the connecting roll can be located for the connection so that the registers are matched correctly.

Another feature or aspect of an embodiment is believed at the time of the filing of this patent application to possibly reside broadly in a supply unit, characterized by means with which the holding and positioning element can be fastened in the desired position in the connecting area of the connecting roll before the insertion of the holding and positioning element into the receptacle.

Yet another feature or aspect of an embodiment is believed at the time of the filing of this patent application to possibly reside broadly in a supply unit as claimed in Claim 13 or 14, characterized by a fastening gauge for the correctly positioned fastening of the holding and positioning element to the connecting area of the connecting roll.

Still another feature or aspect of an embodiment is believed at the time of the filing of this patent application to possibly reside broadly in a supply unit, characterized by the fact that the fastening gauge is realized for the fastening of the holding and positioning element to said gauge in the correct position.

A further feature or aspect of an embodiment is believed at the time of the filing of this patent application to possibly reside broadly in a supply unit, characterized by the fact that the holding and positioning element is a pinch rail.

Another feature or aspect of an embodiment is believed at the time of the filing of this patent application to possibly reside broadly in a supply unit, characterized by the fact that the receptacle for the holding and positioning element can be rotated around an axis that lies parallel to the plane of the flat material of the roll that is in use and perpendicular to the direction of movement of the flat material at the connecting position.

Yet another feature or aspect of an embodiment is believed at the time of the filing of this patent application to possibly reside broadly in a supply unit, characterized by the fact that the roll receptacles are mandrels on which the rolls can be installed by pushing onto said mandrels.

Still another feature or aspect of an embodiment is believed at the time of the filing of this patent application to possibly reside broadly in a supply unit, characterized by the fact that the receptacles can be rotated around an axis that lies parallel to the mandrels.

A further feature or aspect of an embodiment is believed at the time of the filing of this patent application to possibly reside broadly in a supply unit, characterized by the fact that the connecting station is located between the roll holders.

Another feature or aspect of an embodiment is believed at the time of the filing of this patent application to possibly reside broadly in a supply unit, characterized by the fact that when the flat material is realized in the form of a material that can be welded by the application of heat, e.g. in the form of a weldable film, in the at least one connecting position there is at least one welding element, e.g. in the form of a heated welding rail, that can be moved by at least one actuator element from a retracted idle position into a working and welding position.

Yet another feature or aspect of an embodiment is believed at the time of the filing of this patent application to possibly reside broadly in a supply unit, characterized by the fact that the at least one welding element is realized for a welding cutting operation.

Still another feature or aspect of an embodiment is believed at the time of the filing of this patent application to possibly reside broadly in a supply unit, characterized by the fact that at least one welding element is provided on both sides of the rotating receptacle.

A further feature or aspect of an embodiment is believed at the time of the filing of this patent application to possibly reside broadly in a supply unit, characterized by at least one first sensor to monitor the consumption of the film on the roll that is in use and for the automatic initiation of the roll change by means of a control unit or a control computer.

Another feature or aspect of an embodiment is believed at the time of the filing of this patent application to possibly reside broadly in a supply unit, characterized by the fact that the at least one first sensor monitors the diameter of the roll that is in use.

Yet another feature or aspect of an embodiment is believed at the time of the filing of this patent application to possibly reside broadly in a supply unit, characterized by at least one second sensor to monitor the flat material of the roll that is in use, and for the controlled stopping of the movement of said flat material after the initiation of the roll change and before the connection with the connecting area of the connecting roll.

A further feature or aspect of an embodiment is believed at the time of the filing of this patent application to possibly reside broadly in a supply unit, wherein the at least one first sensor and/or the at least one second sensor monitor markings on the flat material.

Another feature or aspect of an embodiment is believed at the time of the filing of this patent application to possibly reside broadly in a supply unit, characterized by means to keep the tension on the strip-shaped flat material constant and/or to reduce the tension and/or to block the movement of the flat material during the roll change.

Another feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling elements for filling beverage bottles with liquid beverage material; at least one liquid reservoir being configured to hold a liquid to be bottled; said at least one liquid reservoir comprising a gas headspace being disposed above a liquid to be bottled within said at least one liquid reservoir; at least one supply line being configured and disposed to connect said at least one liquid reservoir to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; a computer control system being configured and disposed to monitor and control operation of said beverage bottling plant; said computer control system comprising a control computer arrangement being configured and disposed to monitor and control operation of said bottle packing station; said beverage bottle packing station comprising: a first mandrel being configured and disposed to hold a roll of film or plastic wrapping material; a second mandrel being configured and disposed to hold a roll of film or plastic wrapping material; said first and second mandrels being disposed substantially parallel to each other in said bottle packing station; said first mandrel being configured and disposed to be in an operative position while said second mandrel is configured and disposed to be in a inoperative or stand-by position; a plurality of deflector rollers being configured and disposed to guide film or plastic wrapping material away from said first and second mandrels; a rotating receptacle being configured and disposed to hold film or plastic wrapping material of said second, inoperative mandrel in a ready position; a first sensor being configured and disposed to detect when said first, operative mandrel is nearly empty and to send a signal to said control computer arrangement; a second sensor being configured and disposed to scan the film or plastic wrapping or markings or printed marks on the film or plastic wrapping and to send a signal to said control computer arrangement; a pinch rail being disposed on said rotating receptacle; said pinch rail being configured and disposed to hold film or plastic wrapping material of said second, inoperative mandrel on said rotating receptacle; said pinch rail being configured to hold film or plastic wrapping material of said second, inoperative mandrel in a position such that the markings or patterns on film or plastic wrapping material of said second, inoperative mandrel will match with the markings or patterns on said first, operative mandrel upon the welding together of both sheets of film or plastic wrapping material; a plurality of welding rails being configured and disposed to weld film or plastic wrapping material from said first, operative mandrel to said second, inoperative mandrel upon said first sensor detecting when said first, operative mandrel is nearly empty; said plurality of welding rails being configured and disposed to cut or separate film or plastic wrapping material from the remaining film or plastic wrapping material on said first, operative mandrel and to cut or separate the film or plastic wrapping material that remains on said pinch rail; an actuator element being configured and disposed to move said plurality of welding rails into an operative position for welding film or plastic wrapping material upon receiving a signal from said control computer arrangement; an equalizing station being disposed beneath said welding rails; said equalizing station being configured and disposed to pull film or plastic wrapping material taught prior to wrapping bottles in film or plastic wrapping material; and said control computer arrangement being configured to accept signals from said first and second sensors, and being configured to send signals to said plurality of welding rails, said first and second mandrels, said rotating receptacle, and said actuator element for said plurality of welding rails.

Still another feature or aspect of an embodiment is believed at the time of the filing of this patent application to possibly reside broadly in a method of operating a beverage bottling plant including operating a packaging machine and a roll change on a supply unit that feeds a strip-shaped flat material to a packaging machine or similar processing machine from rolls that form a supply of flat material, whereby for the roll change, in which in a connecting station, the flat material of the roll that is in use is connected with a leading or connecting area of a previously prepared connecting roll, this connecting area is accurately positioned in the connecting station to achieve a connection with matching registers, and after the connection has been made the flat material is separated from the roll that was in use up to the time of the roll change, wherein for the correct positioning of the connecting area of the flat material of the connecting roll, a holding and positioning element is fastened in the desired position and orientation in a workplace outside the supply unit, and that before the role change, the connecting area of the connecting roll is positioned with the holding and positioning element in the receptacle provided on the connecting station.

A further feature or aspect of an embodiment is believed at the time of the filing of this patent application to possibly reside broadly in a method of operating a packaging machine in a container filling plant and for performing a roll change on a supply unit that feeds a strip-shaped flat material to a packaging machine or similar processing machine from rolls that form a supply of flat material, whereby for the roll change, in which in a connecting station, the flat material of the roll that is in use is connected with a leading or connecting area of a previously prepared connecting roll, this connecting area is accurately positioned in the connecting station to achieve a connection with matching registers, and after the connection has been made the flat material is separated from the roll that was in use up to the time of the roll change, wherein for the correct positioning of the connecting area of the flat material of the connecting roll, a holding and positioning element is fastened in the desired position and orientation in a workplace outside the supply unit, and that before the role change, the connecting area of the connecting roll is positioned with the holding and positioning element in the receptacle provided on the connecting station.

Another feature or aspect of an embodiment is believed at the time of the filing of this patent application to possibly reside broadly in a method of operating a container filling plant including operating a packaging machine and a roll change on a supply unit that feeds a strip-shaped flat material to a packaging machine or similar processing machine from rolls that form a supply of flat material, whereby for the roll change, in which in a connecting station, the flat material of the roll that is in use is connected with a leading or connecting area of a previously prepared connecting roll, this connecting area is accurately positioned in the connecting station to achieve a connection with matching registers, and after the connection has been made the flat material is separated from the roll that was in use up to the time of the roll change, wherein for the correct positioning of the connecting area of the flat material of the connecting roll, a holding and positioning element is fastened in the desired position and orientation in a workplace outside the supply unit, and that before the role change, the connecting area of the connecting roll is positioned with the holding and positioning element in the receptacle provided on the connecting station.

Yet another feature or aspect of an embodiment is believed at the time of the filing of this patent application to possibly reside broadly in a container filling plant comprising a supply unit to feed a strip-format flat material to a packaging machine or similar processing machine, with at least two roll receptacles, each of which holds a supply of flat material in the form of a roll, from at least one roll of which, namely the role that is in use, the flat material is pulled off during the operation of the packaging machine or similar processing machine, and at least one additional roll forms a connecting roll that is ready for the roll change, with a connecting station through which the flat material of the roll that is in use is transported, and on which, in a connecting position, a connecting area of the flat material of the connecting roll is located and positioned correctly for a connection so that the registers are matched correctly, wherein at the connecting position, a receptacle is provided in which a holding and positioning element that is fastened to the connection area of the connecting roll can be located for the connection so that the registers are matched correctly.

Still another feature or aspect of an embodiment is believed at the time of the filing of this patent application to possibly reside broadly in a packaging machine comprising a supply unit to feed a strip-format flat material to a packaging machine or similar processing machine, with at least two roll receptacles, each of which holds a supply of flat material in the form of a roll, from at least one roll of which, namely the role that is in use, the flat material is pulled off during the operation of the packaging machine or similar processing machine, and at least one additional roll forms a connecting roll that is ready for the roll change, with a connecting station through which the flat material of the roll that is in use is transported, and on which, in a connecting position, a connecting area of the flat material of the connecting roll is located and positioned correctly for a connection so that the registers are matched correctly, wherein at the connecting position, a receptacle is provided in which a holding and positioning element that is fastened to the connection area of the connecting roll can be located for the connection so that the registers are matched correctly.

The components disclosed in the various publications, disclosed or incorporated by reference herein, may possibly be used in possible embodiments of the present application, as well as equivalents thereof.

Some examples of bottling systems, which may be used or adapted for use in at least one possible embodiment of the present may be found in the following U.S. Patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The appended drawings in their entirety, including all dimensions, proportions and/or shapes in at least one embodiment of the invention, are accurate and are hereby included by reference into this specification.

Some examples of cutting apparatus that may possibly be utilized or possibly adapted for use in at least one possible embodiment of the present may possibly be found in the following U.S. Patents: U.S. Pat. No. 5,060,367 issued to Vandevoorde on Oct. 29, 1991; U.S. Pat. No. 5,091,237 issued to Scloegl et al. on Feb. 25, 1992; U.S. Pat. No. 5,715,651 issued to Thebault on Feb. 10, 1998; U.S. Pat. No. 5,916,343 issued to Huang et al. on Jun. 29, 1999; U.S. Pat. No. 6,502,488 issued to Taylor on Jan. 7, 2003; and U.S. Pat. No. 6,684,599 issued to Fresnel on Feb. 3, 2004.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of bottling systems which may possibly be utilized or adapted for use in at least one possible embodiment may possibly be found in the following U.S. Patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

All, or substantially all, of the components and methods of the various embodiments may be used with at least one embodiment or all of the embodiments, if more than one embodiment is described herein.

The Innopack packaging machine and the SP-35 Shrink-Packer, manufactured by KHS Maschinen und Anlagenbau AG, located at Juchostrasse 20. 44143 Dortmund, Germany, and probably sold in the United States by Kisters Kayat Inc., 4100 U.S. Highway #1 South, Sarasota Florida, 32141, U.S.A., and KHS Kisters Packing Technology Division, located at Boschstrasse 1-3, D-47533 Kleve, Germany, are examples of packaging machines which may possibly be utilized or adapted for use in at least one possible embodiment. Other examples of packing machines manufactured by KHS Maschinen und Anlagenbau AG may be found on the following website: http://www.packexpo.com/ve/35175/products.html. Some other examples of packaging machines which may possibly be utilized or adapted for use in at least one possible embodiment may possibly be found in the following U.S. Patents: U.S. Pat. No. 4,964,260, entitled "Packaging machine for cardboard boxes and process for packaging articles in cardboard boxes;" U.S. Pat. No. 4,785,610, entitled "Automatic machine for packaging products of different kinds in boxes;" U.S. Pat. No. 5,265,398, entitled "Automatic counting and boxing machine;" U.S. Pat. No. 5,943,847, entitled "Packaging machine for multi-packs;" U.S. Pat. No. 5,937,620, entitled "Packaging machine for multi-packs;" U.S. Pat. No. 5,711,137, entitled "Packaging machine and method of packaging articles;" and U.S. Pat. No. 5,706,633, entitled "Packaging machine and method of packaging articles."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of wrapping machines which may possibly be utilized or adapted for use in at least one possible embodiment may possibly be found in the following U.S. Patents: U.S. Pat. No. 6,484,475, entitled "Modular packaging machine;" U.S. Pat. No. 4,694,633, entitled "Film wrapping machine;" U.S. Pat. No. 4,118,916, entitled "Thermoplastic wrapping machine;" U.S. Pat. No. 4,118,916, entitled "Thermoplastic wrapping machine;" U.S. Pat. No. 5,371,999, entitled "Shrink film wrapping machine;" U.S. Pat. No. 4,748,795, entitled "Film wrapping machine;" and U.S. Pat. No. 5,115,620, entitled "Wrapping machine."

All of the patents, patent applications and publications recited herein, and in the Declaration attached hereto, are hereby incorporated by reference as if set forth in their entirety herein.

Some examples of shrink wrapping machines or machines for wrapping items in plastic film which may possibly be utilized or adapted for use in at least one possible embodiment may possibly be found in the following U.S. Patents: U.S. Pat. No. 6,826,893, entitled "Apparatus for wrapping products with plastic film;" U.S. Pat. No. 6,739,115, entitled "Equipment for wrapping groups of products in plastic film;" U.S. Pat. No. 5,878,555, entitled "Apparatus for wrapping articles in plastic film;" U.S. Pat. No. 5,787,691, entitled "Apparatus for wrapping articles in plastic film;" U.S. Pat. No. 5,519,983, entitled "Shrink wrap packaging system with an ultrasonic side sealer;" U.S. Pat. No. 4,956,963, entitled "Method of sealing a shrink wrap package;" U.S. Pat. No. 4,873,814, entitled "Method of making a shrink wrap package;" and U.S. Pat. No. 4,214,419, entitled "Collating and shrink wrap packaging apparatus."

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of rotation sensors that may possibly be utilized or possibly adapted for use in at least one possible embodiment of the present application may possibly be found in the following U.S. Patents: U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of control valve apparatus that may possibly be utilized or possibly adapted for use in at least one possible embodiment of the present application may possibly be found in the following U.S. Patents: U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

The corresponding foreign patent publication applications, namely, Federal Republic of Germany Patent Application No. 10 2004 032 528.6, filed on Jul. 6, 2004, having inventors Manfred von Triel and Tuchwat Schagidow, and DE-OS 10 2004 032 528.6 and DE-PS 10 2004 032 528.6, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of pneumatic arrangements that may possibly be utilized or possibly adapted for use in at least one possible embodiment of the present application may possibly be found in the following U.S. Patents: U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of position sensors or position sensor systems that may be used or adapted for use in at least one possible embodiment of the present invention may be found in the following U.S. Patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of cameras or optical monitoring apparatuses which may possibly be utilized or adapted for use in at least one possible embodiment may possibly be found in U.S. patent application having Ser. No. 10/780,280, entitled "A beverage bottling plant for filling bottles with a liquid beverage filling material, a container filling plant container information adding station, such as, a labeling station, configured to add information to containers, such as, bottles and cans, and modules for labeling stations," filed by Applicant on Feb. 17, 2004. The above application is hereby included by reference as if set forth in its entirety herein.

Some examples of cameras or the like optical monitoring apparatus that may possibly be utilized or possibly adapted for use in at least one possible embodiment of the present application may possibly be found in the following U.S. Patents: U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OF TERMS:

1 Supply unit
2 Flat material or film
2.1 Printed marks
3 Machine frame
4, 5 Mandrel
6, 7 Film roll
8-10 Deflector rollers
11 Frame
12 Welding or connecting station
13 Roller
14 Equalizing station
15 Rotating receptacle
16 Pinch rail
17, 18 Welding rail
19 Sensor
20 Control computer
21 Sensor
22 Guide ruler
23, 24 Marking
25, 26 Actuator element
A Direction of movement of the film 2 fed to the packaging machine
B Feed direction of the welding rails 17

What is claimed is:

1. A method of operating a container filling plant packaging machine comprising: a supply unit to feed a strip-format flat material for packaging containers; said supply unit comprising at least two roll receptacles, each of which holds a supply of flat material in the form of a roll, wherein from at least one roll, namely the role that is in use, the flat material is pulled off during the operation of the packaging machine, and the at least one additional roll forms a connecting roll that is ready for a roll change; and said supply unit comprising a connecting station through which the flat material of the roll that is in use is transported, and on which, in a connecting position, a connecting area of the flat material of the connecting roll is located and positioned correctly for a connection so that the registers are matched correctly, wherein at the connecting position, a rotatable receptacle is provided in which a holding and positioning element that is fastened to the connection area of the connecting roll can be located for the connection so that the registers are matched correctly; said method comprising the steps of:

feeding a strip-format flat material through said packaging machine from the roll that forms said supply of flat material and is in use;

changing the roll that is in use with the connecting roll in the connecting station, said step of changing comprising:

fastening the holding and positioning element to the connecting area of the flat material of the connecting roll in a desired position and orientation at a workplace outside the supply unit for the correct positioning of the connecting area of the flat material of the connecting roll;

positioning the connecting area of the connecting roll with the holding and positioning element fastened thereon in the receptacle provided in the connecting station;

rotating the receptacle to the connecting position in the connecting station;

connecting the flat material of the roll that is in use to the connecting area of the flat material of the connecting roll;

separating the flat material from the roll that is in use after the connection has been made; and releasing the connecting area of the flat material of the connecting roll from the holding and positioning element so that the connecting roll becomes the roll in use.

2. The method of operating a container filling plant packaging machine according to claim 1, wherein said method further comprises fastening, with a device, said holding and positioning element in the desired position to the connecting area of said connecting roll before positioning said holding and positioning element in said receptacle.

3. The method of operating a container filling plant packaging machine according to claim 2, wherein:

said device comprises a fastening gauge configured to permit the fastening of said holding and positioning element to the connecting area of said connecting roll, in the desired position; and said step of fastening said holding and positioning element in the desired position comprises using said fastening gauge to fasten said holding and positioning element to the connecting area of said connecting roll in the desired position.

4. The method of operating a container filling plant packaging machine according to claim 3, wherein:

said holding and positioning element comprises a pinch rail;

said step of positioning the connecting area of the connecting roll with said holding and positioning element fastened thereon in said receptacle comprises inserting said pinch rail into said receptacle; and said step of rotating said receptacle comprises rotating said receptacle around an axis that lies parallel to the plane of the flat material of the roll that is in use and perpendicular to the direction of movement of the flat material at the connecting position.

5. The method of operating a container filling plant packaging machine according to claim 4, wherein:

said at least two roll receptacles comprise mandrels disposed essentially parallel to the axis of said receptacle; and said method further comprises the step of pushing a roll of flat material onto each one of said mandrels.

6. The method of operating a container filling plant packaging machine according to claim 5, wherein:

said connecting station is located between the roll holders;

said flat material comprises a weldable film that can be welded by the application of heats; and said step of connecting the flat material of the roll that is in use to the connecting area of the flat material of the connecting roll comprises applying heat to the flat material of each roll to weld and thus connect the flat material of each roll together.

7. The method of operating a container filling plant packaging machine according to claim 6, wherein:

said packaging machine comprises at least one welding element that can be moved by at least one actuator element from a retracted idle position into a working and welding position, which said at least one welding element is disposed at the at least one connecting position;

said at least one welding element is realized for a welding cutting operation; and said at least one welding element is provided on both sides of the rotating receptacle.

8. The method of operating a container filling plant packaging machine according to claim 7, wherein:

said at least one welding element comprises a heated welding rail;

said packaging machine comprises at least one first sensor to monitor the consumption of the film on the roll that is in use and for the automatic initiation of the roll change by means of a control unit or a control computer;

said at least one first sensor monitors the diameter of the roll that is in use;

said packaging machine comprises at least one second sensor to monitor the flat material of the roll that is in use, and for the controlled stopping of the movement of said flat material after the initiation of the roll change and before the connection with the connecting area of the connecting roll; and at least one of said at least one first sensor and said at least one second sensor is configured to monitor markings on the flat material.

9. The method of operating a container filling plant packaging machine according to claim 8, wherein:

said packaging machine comprises an arrangement to keep the tension on the strip-shaped flat material constant and/or to reduce the tension and/or to block the movement of the flat material during the roll change; and said method further comprises at least one of the steps of: maintaining tension on the strip-shaped flat material constant, reducing the tension, blocking movement of the flat material during the roll change.

10. The method of operating a container filling plant packaging machine according to claim 9, wherein:

the holding and positioning element is fastened to the connecting area in the correct position using the gauge that is located in or on the holding and positioning element in a specified position and orientation, and using markings on this gauge and/or on the flat material;

the connection of the flat material on the roll that is in use with the connecting area of the flat material on the connecting roll is realized in an overlapping manner so that the overlapping connection forms a lapped connection on one side of the strip of the flat material;

the insertion of the holding and positioning element, the receptacle on the connecting station is rotated around an axis that lies parallel to the plane of the flat material on the roll that is in use as it moves past the receptacle and perpendicular to the direction of movement of said flat material over an angular range of 360°, so that the connecting area overlaps the flat material on the roll that was in use before the roll change, and extends, starting at this overlap, from the holding and positioning element in the direction of movement of the flat material that is in use;

during the roll change and before the connection of the connecting area of the connecting roll, the movement of the flat material in use is stopped in a controlled manner, so that taking into consideration the correct positioning of the holding and positioning element in the receptacle, the flat material of the connecting roll can be connected to the flat material in use with accurate register matching;

the movement of the flat material that is in use is stopped in a controlled manner for the roll change by means of printed marks that are provided on the flat material;

the fastening of the holding and positioning element in the correct position in the separate workplace is done taking into consideration printed markings on the flat material; and after the connection or during the connection, the flat material is separated from the holding and positioning element.

11. The method of operating a container filling plant packaging machine according to claim 1, wherein:

the holding and positioning element is a pinch rail; and said step of positioning the connecting area of the connecting roll with said holding and positioning element fastened thereon in said receptacle comprises inserting said pinch rail into said receptacle.

12. The method of operating a container filling plant packaging machine according to claim 11, wherein the holding and positioning element is fastened to the connecting area in the desired position using a gauge that is located in or on the holding and positioning element in a specified position and orientation, and using markings on this gauge and/or on the flat material.

13. The method of operating a container filling plant packaging machine according to claim 12, wherein:

the connection of the flat material on the roll that is in use with the connecting area of the flat material on the connecting roll is realized in an overlapping manner, so that the overlapping connection forms a lapped connection on one side of the strip of the flat material; and said method further comprises overlapping the connection of the flat material on the roll that is in use with the connecting area of the flat material on the connecting roll to form a lapped connection on one side of the strip of the flat material.

14. The method of operating a container filling plant packaging machine according to claim 13, wherein said step of, rotating the receptacle comprises rotating the receptacle around an axis that lies parallel to the plane of the flat material on the roll that is in use as it moves past the receptacle and perpendicular to the direction of movement of said flat material over an angular range of 360°, so that the connecting area overlaps the flat material on the roll that was in use before a roll change, and extends, starting at this overlap, from the holding and positioning element in the direction of movement of the flat material that is in use.

15. The method of operating a container filling plant packaging machine according to claim 14, wherein during the roll change and before the connection of the connecting area of the connecting roll, the movement of the flat material in use is stopped in a controlled manner, so that taking into consideration the correct positioning of the holding and positioning element in the receptacle, the flat material of the connecting roll can be connected to the flat material in use with accurate register matching.

16. The method of operating a container filling plant packaging machine according to claim 15, wherein the movement of the flat material that is in use is stopped in a controlled manner for the roll change by means of printed marks that are provided on the flat material.

17. The method of operating a container filling plant packaging machine according to claim 16, wherein the fastening of the holding and positioning element in the correct position in the separate workplace is done taking into consideration printed markings on the flat material.

18. The method of operating a container filling plant packaging machine according to claim 17, wherein the flat material is a weldable film, and that the connection during the roll change is effected by a welding operation.

19. The method of operating a container filling plant packaging machine according to claim 18, wherein after the connection or during the connection, the flat material is separated from the holding and positioning element.

20. The method of operating a container filling plant packaging machine according to claim 19, wherein:

the controlled stopping of the flat material that was in use before the roll change, the connection and separation of the flat material from the roll that was in use before the roll change and from the holding and positioning element, and a subsequent additional removal of the flat material from the connecting roll are controlled by a computer; and the roll change is initiated by at least one sensor that monitors the strip of the flat material in use or the roll that is in use.

* * * * *

UNITED STATES PATENT AND TRADEMARK OFFICE

CERTIFICATE OF CORRECTION

PATENT NO. : 7,263,812 B2
APPLICATION NO. : 11/175002
DATED : September 4, 2007
INVENTOR(S) : Manfred von Triel and Tuchwat Schagidow It is certified that error appears in the above-identified patent and that said Letters Patent is hereby corrected as shown below:

In column 21, line 46, after 'of', delete "heats;" and insert --heat;--.

In column 23, line 36, before 'rotating', delete "of," and insert --of--.

Signed and Sealed this

Twenty-ninth Day of April, 2008

JON W. DUDAS
*Director of the United States Patent and Trademark Office*